United States Patent [19]

Reinke et al.

[11] 4,165,246

[45] Aug. 21, 1979

[54] PROCESS FOR THE HEAT TREATMENT OF THICK WALLED STEEL PIPES

[75] Inventors: Friedhelm Reinke, Remscheid; Friedhelm Emde, Hückeswagen, both of Fed. Rep. of Germany

[73] Assignee: Aeg-Elotherm, G.m.b.H., Remscheid-Hasten, Fed. Rep. of Germany

[21] Appl. No.: 790,909

[22] Filed: Apr. 26, 1977

[30] Foreign Application Priority Data

May 8, 1976 [DE] Fed. Rep. of Germany ..... 2620377

[51] Int. Cl.[2] ..... C21D 9/08; C21D 9/14

[52] U.S. Cl. ..... 148/150; 148/152; 148/153

[58] Field of Search ..... 148/150, 153, 152

[56] References Cited

U.S. PATENT DOCUMENTS

| | | | |
|---|---|---|---|
| 2,240,019 | 4/1941 | Quarnstrom et al. | 148/153 |
| 2,604,419 | 7/1952 | Herbenar | 148/150 |
| 3,140,964 | 7/1964 | Middlemiss | 148/153 |
| 3,144,365 | 8/1964 | Ditson | 148/150 |
| 3,189,490 | 6/1965 | Scott | 148/153 |
| 3,407,099 | 10/1968 | Schell | 148/153 |
| 3,755,010 | 8/1973 | Moliterno | 148/153 |

*Primary Examiner*—W. Stallard

*Attorney, Agent, or Firm*—Cushman, Darby & Cushman

[57] ABSTRACT

A process in which pipes, particularly thick walled pipes, are inductively heated to the austenization temperature, quenched with a coolant to form martensite in the surface zone, then drawn, with additional heat added when necessary and left to cool with the not-quenched layers forming an interstage structure.

2 Claims, 1 Drawing Figure

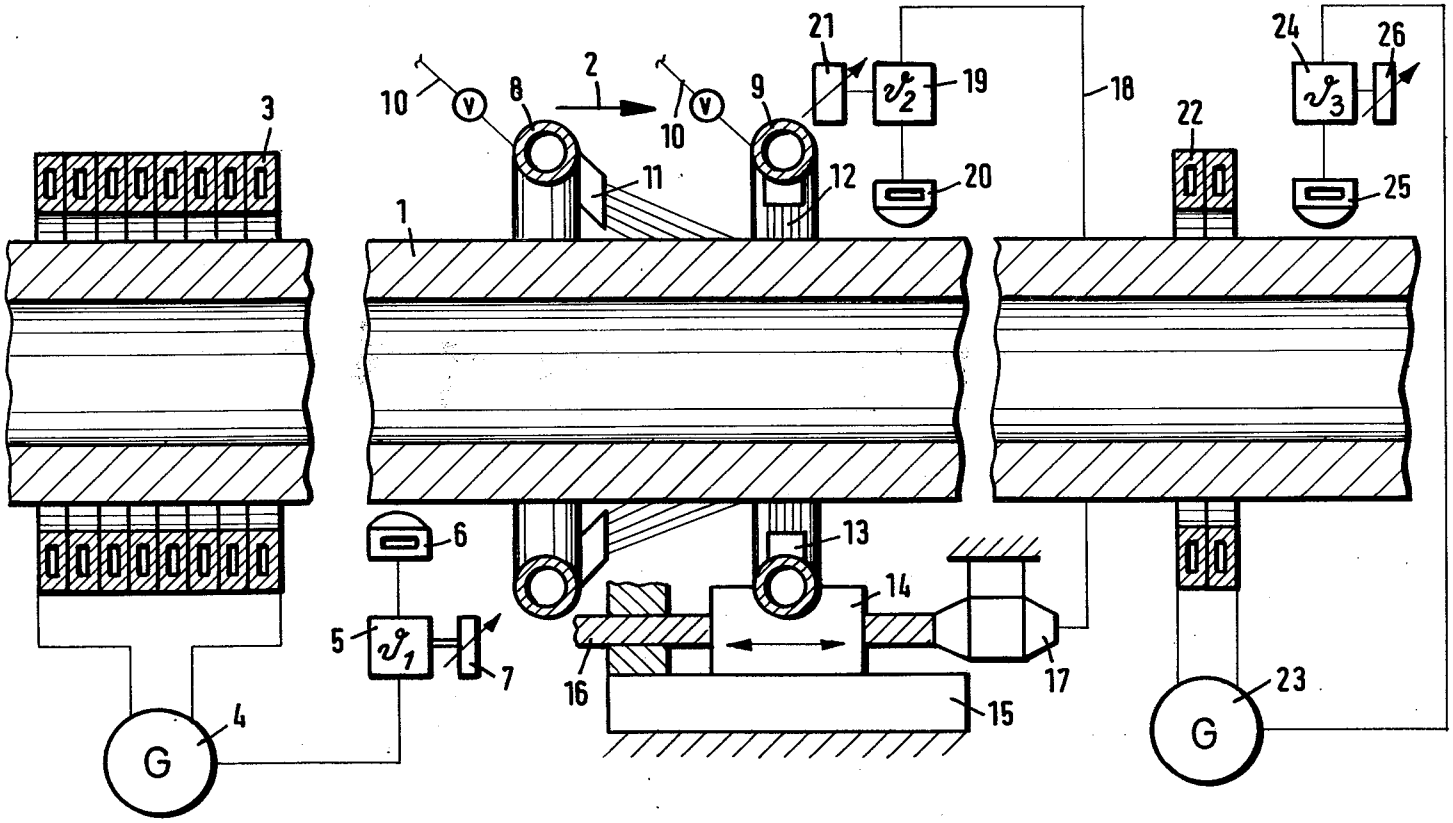
1
2
3
4
5
6
7
8
9
10
11
12
13
14
15
16
17
18
19
20
21
22
23
24
25
26
G
G

PROCESS FOR THE HEAT TREATMENT OF THICK WALLED STEEL PIPES

The invention relates to a process for the tempering of thick-walled steel pipes by heat treatment of the pipe material during passage of the pipes along their longitudinal direction through heat treatment stations at a predeterminable speed of transit, wherein parts of the pipe material lying side by side in the direction of the longitudinal axis of the pipe are mutually displaced and are subjected successively to the same heat treatment.

In order to increase the strength of a steel pipe, it is known to heat the pipe to its austenization temperature, quench the pipe at an overcritical speed while forming a martensitic structure, and finally again heat the pipe to a tempering temperature and temper. This type of treatment, which is also called age-hardening, improves the strength of the pipe, so that pipes thus treated will satisfy higher mechanical requirements than untreated pipes.

In order to preserve the form stability of the pipe surface, the pipes are tempered as a rule in a continuous transit process, whereby sections of the pipes lying side by side along the longitudinal axis of the pipes, are first heated successively one after the other and then quenched and finally tempered. Heat treatment installations suitable for the treatment of the pipes consist as a rule of a hardening section which comprises a cooling section beside a heating section and through which the pipes pass at a selectable speed on rollers etc., along their longitudinal direction and from a tempering furnace which, developed as a stationary furnace, serves for tempering of the hardened pipes.

For the improvement of profitability it has also been known, to temper the pipes in a continuous transit process so that the pipe material is first heated in a reheating furnace in transit, is then quenched in a cooling section in transit and is finally again heated to drawing temperature in an additional transit furnace for the purpose of drawing and is drawn (annealed). The heating section used for the austenization of the pipe material may be at the same time also be used for drawing the pipe material during the return of the tempered pipe.

This known process, in the case of thick-walled steel pipes however, encounters difficulties which result from the thickness of the wall. Thus it will be necessary, in case, e.g., of increasing thickness of the walls of the pipe jacket, that not only the heating performances of the heating sections, but also the cooling performances of the pertinent quenching stations will have to be increased and adapted to the pertinent wall thickness. The expenditure is considerable, even to reduce the pertinent transit speeds of the pipes through the heat treatment stations.

The invention relates to a process for the heat treatment of thick-walled steel pipes for the purpose of improving the strength characteristics of the pipe material, which will permit carrying out the heat treatment in passage through serially switched heat treatment stations, even in case of thick-walled steel pipes, in a way which will reduce the required energy for heating.

This task is solved, according to this invention by a process of the initially described type, by first heating the pipes over the cross section of the pipe wall to the austenization temperature, then quenching the surface by feeding in of a coolant while forming martensite in the surface zone, and drawing automatically behind the quenching station in the surface by supplying heat from the not yet quenched wall parts and the pipes are left to cool in these parts while forming an interstage structure.

In a further development of the invention where the residual heat is insufficient in the untempered wall parts, to support the drawing process after quenching heat is supplied to the cross section of the pipe, and also to improve the formation of interstage structure by compensating for heat losses of the pipe, by way of supplying a corresponding quantity of compensation heat.

The process of the invention may be used preferably for the tempering of steel pipes, the wall thickness of which, in case of quenching the convex jacket of the pipe, from its inside or outside surface, does not exceed an amount of 16 to 18 mm at the present state of the prior art. In so far as the quenching of the convex surface of the pipe after austenization of its material takes place from the direction of both the inner as well as the outer surface of the convex surface of the pipe, this process of the invention is used preferably for the heat treatment of steel pipes, the wall thickness of which exceeds double the amount mentioned.

Pipes, which have been treated according to the process of the invention, have a structure in their jacket—depending on the type of quenching—which consists of two or three concentric zones, which on the side of the quenched surface show the customary temper structure and beneath the temper structure the development of the known interstage structure.

The development of the interstage structure, at the same time may be influenced by control of the cooling process—possibly while supplying auxiliary heat—after the time of quenching. At the same time it will be effective to maintain the heat content of the pipe jacket possibly for a period which will suffice to conclude the formation of an interstage structure at a constant or approximately constant level. For this purpose it will be appropriate to reduce the cooling down of the pipe jacket, quenched in parts, by suitable screenings etc., which decrease losses of heat by heat reflection and heat deflection.

The process of the invention will be explained in more detail subsequently on the basis of the attached drawing which schematically depicts one embodiment of the present invention for carrying out the process.

In the drawing, a thick-walled steel pipe 1 may be transported in the direction of arrow 2 at a predetermined speed along its longitudinal axis on rolls, etc. by means of suitable driving means through several heating stations for heat treatment.

The heat treatment stations include a first station consisting of an induction coil 3, which encircles the jacket of a pipe 1 from the outside and is fed an AC current at a power supply frequency. The AC current may be taken from a current supply source 4 of adjustable output, the starting output of which is regulated by an output regulator 5. To the regulator 5 is attached a temperature recorder 6 which measures the surface temperature of the jacket of pipe 1 after passing induction coil 3. The electric output signal of recorder 6 is fed to an inlet of the regulator 5 as an actual value signal and is compared with a pertinent theoretical value signal, which may be predetermined by means of an adjusting arrangement 7 on regulator 5.

The starting signal of the output regulator 5 conventionally controls, as the adjusting signal, the output of generator 4 so that the surface temperature of the jacket of pipe 1 is adjustably constant of measuring device 6. A cooling station follows the induction coil 3, and consists of two annular pipe lines 8 and 9, which are connected via pertinent pipelines 10 and corresponding valves, with a cold water line. The annular pipe lines 8 and 9 are equipped with annular discharge nozzles 11 and 13, which nozzles are distributed around the axis of pipe 1, to encircle the surface of the pipe jacket annularly and feed the cooling water emerging from the inside of annular pipe lines 8 and 9, to the surface of the pipe jacket. The bodies 11 of the discharge nozzles are aligned for this purpose in such a way, that jets of water run at an acute angle slanting toward the surface of the pipe jacket to cool the pipe jacket. The bodies of nozzles 13 guide the pertinent jets of water 12 perpendicularly onto the surface of the pipe jacket, whereby the jets of water emerging from nozzles 13 form a dense curtain of water, which impedes the passage of the jets of water emerging from nozzles 11. Annular pipe 9 is mounted adjustably along the longitudinal axis of said pipe 1, for adjusting the length of the cooling zone, measured in the longitudinal direction of the pipe axis, which is cooled by the jets of water of the nozzles 11 on the surface of the pipe jacket. For movement, pipe 9 is attached to a stand 14, which on its part is shiftable in a bearing 15 along the longitudinal axis of pipe 1. The shifting is accomplished by means of a screw spindle 16 which adjusts the stand 14 via an assigned thread and which may be driven by means of a geared engine 17.

A cooling performance control 19 serves for the control of the geared engine 17, the output signal of which is fed-in via output line 18 to engine 17 for the control of the adjustment of the bearing stand 14.

The control 19 for the cooling performance is controlled on the input side by a measuring signal which is obtained by means of a temperature recorder 20. The temperature recorder 20 measures the surface temperature of the jacket of pipe 1 behind the cooling station. The theoretical value for the surface temperature which is measured by means of a guage 20, is predetermined by means of a theoretical value adjuster 21 on the control 19.

An additional heating section 22 follows the cooling station and likewise consists of an induction coil which may be supplied with alternating current of network frequency from a source 23. Coil 22 has a relatively short overall length and heats the pipe 1 at a high output ratio. The initial output of the AC source 23 or its starting current is controlled by means of a control 24, which is controlled via a temperature gauge 25 with an actual value signal in dependence on the surface temperature of the pipe material, and in dependence on an actual value signal, which (gauge 25) may be adjusted by means of a theoretical value control 26 on the control 24.

The arrangement described operates as follows: The pipe 1 is guided (fed) to the induction coil 3 at a selectable, constant transportation speed and is heated inductively—while passing through the induction coil 3—to the austenization temperature of the material of the pipe jacket. The austenized pipe material is quenched from the direction of its surface in the cooling station 8, 9 with an adjustable cooling output, to a temperature which is below the martensite limit of its material, at a speed dependent on the cooling performance of the cooling station and the transportation speed of pipe 1, which is greater than the critical cooling speed, so that a martensitic structure develops in the outside layer of the pipe jacket. The thickness of the thus tempered pipe layer may be freely selected by adjustment of the cooling performance of the cooling station within certain limits. The thickness of the tempered or of the untempered wall layer is selected such, that the residual heat, remaining in the untempered wall layer after quenching, will be sufficient for drawing (annealing) the material in the tempered layer. At the same time, the heat of the untempered wall layer is automatically and partly transmitted into the tempered layer, as a result of which the martensitic layer is heated and drawn. In the untempered layer, the temperature of which is above the martensite limit, an interstage structure develops, the formation of which is supported by a certain quantity of auxiliary heat via the heating station of the coil 22. The auxiliary heat, fed to the pipe jacket thus prevents the cooling out of the pipe jacket and thus the dropping of the temperature below a limit, which excludes the further formation of interstage structures. At the same time the tempering process in the tempered part of the pipe material is sustained.

After passage through induction coil 22, the material of the pipe jacket is left to cool to ambient temperature.

It is within the scope of the invention to make the arrangement such, that by screening of the pipe jacket after the cooling station and thus in case of prevention of pertinent heat losses by reflection and heat deflection, the supply of auxiliary heat by a following heat station becomes unnecessary. Whether or not this will succeed in the individual case depends on the alloying addition of the pipe material.

It furthermore is within the scope of the invention to replace the cooling station, which causes a quenching of the outside surface of the jacket of pipe 1, by a cooling station, which accomplishes the quenching from the direction of the inside or the outside and the inside surface.

The process of the invention has the advantage, that it brings about a development of the structure in the pipe wall, which entails a high degree of strength of the wall jacket and which may be produced at the use of minimum energy and with the use of a maximum transportation speed of the pipe. The process therefore may be carried out at a high degree of economic effectiveness and in a cost saving manner.

Many changes and modifications in the above described embodiment of the invention can be carried out without departing from the scope of the invention. Accordingly, that scope is intended to be limited only by the scope of the appended claims.

What is claimed is:

1. In a process for the heat treatment of thick-walled steel pipes in transit in their longitudinal direction through heat treatment stations at a predetermined transit speed, in case of which parts of the pipe jacket lying side by side in the direction of the longitudinal axis of the pipe and mutually displaced and in succession, are subjected to the same heat treatment, and in which the pipes are first heated over the entire cross section of the pipe wall, to the austenization temperature of the pipe material, the improvement wherein said pipes are then quenched only in one of the surface layers of the pipe material by supplying a coolant to the surface to form martensite in said one surface layer while martensite is not formed in the not-quenched wall parts, and are finally drawn automatically in the surface layer by the supply of heat stored in said not-quenched parts of the wall from said first heating to austenization temperature step, which not-quenched parts are left to cool to form an interstage structure.

2. In a process as in claim 1, the further improvement wherein heat is supplied to the body of the pipe after quenching of the pipe material and during cooling of said interstage structure only in order to compensate for losses of heat.

* * * * *